US012302976B2

(12) United States Patent
Postolek

(10) Patent No.: US 12,302,976 B2
(45) Date of Patent: May 20, 2025

(54) REMOVABLE VISOR FOR A HELMET

(71) Applicant: Filip Postolek, Simi Valley, CA (US)

(72) Inventor: Filip Postolek, Simi Valley, CA (US)

(73) Assignee: IP MILL HOLDINGS LLC, Simi Valley, CA (US)

( * ) Notice: Subject to any disclaimer, the term of this patent is extended or adjusted under 35 U.S.C. 154(b) by 0 days.

(21) Appl. No.: 18/272,999

(22) PCT Filed: Jan. 18, 2022

(86) PCT No.: PCT/US2022/012714
§ 371 (c)(1),
(2) Date: Jul. 18, 2023

(87) PCT Pub. No.: WO2022/159364
PCT Pub. Date: Jul. 28, 2022

(65) Prior Publication Data

US 2024/0032641 A1 Feb. 1, 2024

Related U.S. Application Data

(60) Provisional application No. 63/139,073, filed on Jan. 19, 2021.

(51) Int. Cl.
*A42B 3/22* (2006.01)
*A42B 3/32* (2006.01)

(52) U.S. Cl.
CPC ..... *A42B 3/222* (2013.01); *A42B 3/227* (2013.01); *A42B 3/32* (2013.01)

(58) Field of Classification Search
CPC ..... A42B 3/222; A42B 3/227; A42B 3/32
See application file for complete search history.

(56) References Cited

U.S. PATENT DOCUMENTS

| | | | |
|---|---|---|---|
| 5,226,181 | A | 7/1993 | Polednak et al. |
| 5,265,276 | A | 11/1993 | Kimberly, Jr. |
| 5,822,126 | A | 10/1998 | Cursolle et al. |
| 6,457,179 | B1 | 10/2002 | Prendergast |

(Continued)

FOREIGN PATENT DOCUMENTS

| | | | |
|---|---|---|---|
| CN | 109953401 | A | 7/2019 |
| WO | 2020160825 | A1 | 8/2020 |
| WO | 2020160827 | A1 | 8/2020 |

OTHER PUBLICATIONS

International Search Report and Written Opinion in International Application No. PCT/US2022/012714, mailed Apr. 11, 2022, 7 pages.

(Continued)

*Primary Examiner* — Khoa D Huynh
*Assistant Examiner* — Erick I Lopez
(74) *Attorney, Agent, or Firm* — Dickinson Wright PLLC; Andrew D. Dorisio

(57) ABSTRACT

An apparatus for a helmet including a receiver adapted for connecting with an accessory. The apparatus comprises a visor adapted to releasably connect with the receiver, the visor including a repeater adapted to connect with the accessory when the visor is connected to the receiver. The visor may also be adapted to connect with additional items or accessories aside from via the receiver, such as by including a mounting assembly having a picatinny rail. Related methods are also disclosed.

7 Claims, 8 Drawing Sheets

(56) References Cited

U.S. PATENT DOCUMENTS

| | | | | |
|---|---|---|---|---|
| 6,662,370 | B1 | 12/2003 | Buchanan, Jr. | |
| 6,795,977 | B2 | 9/2004 | Basson et al. | |
| 6,820,285 | B2 | 11/2004 | Bataille et al. | |
| 6,916,094 | B1 | 7/2005 | Altabeb | |
| 8,120,857 | B2 | 2/2012 | Hedges et al. | |
| 9,414,633 | B2 | 8/2016 | Giroux Bernier et al. | |
| 9,565,885 | B2 | 2/2017 | Hedges et al. | |
| 9,631,899 | B2 | 4/2017 | Lebel et al. | |
| 9,788,593 | B2 | 10/2017 | Lebel et al. | |
| 10,492,555 | B2 | 12/2019 | Lebel et al. | |
| 10,765,164 | B2 | 9/2020 | Giroux Bernier et al. | |
| 2010/0012692 | A1 | 1/2010 | Harris et al. | |
| 2010/0064405 | A1 | 3/2010 | McGovern | |
| 2015/0026872 | A1* | 1/2015 | Giroux Bernier ..... | A42B 3/04 29/428 |
| 2015/0173444 | A1* | 6/2015 | O'Dell ..... | A42B 3/042 2/422 |
| 2017/0325534 | A1 | 11/2017 | Noordzij et al. | |
| 2020/0000167 | A1 | 1/2020 | Noordzij et al. | |
| 2020/0260811 | A1* | 8/2020 | Long ..... | A42B 3/04 |
| 2021/0137204 | A1* | 5/2021 | Bender ..... | A42B 3/221 |
| 2021/0361020 | A1 | 11/2021 | Keith et al. | |

OTHER PUBLICATIONS

"Tactical Helmet Visor Goggle Anti-Fog Lens Compatible w/ Wilcox L4 series shroud Locked-in Fixed Arm Visor For Airsoft War Game", Aliexpress.com, 19 pages, https://www.aliexpress.com/item/4000805087431.html. [Retrieved Nov. 12, 2020].

* cited by examiner

REMOVABLE VISOR FOR A HELMET

This application claims the benefit of U.S. Provisional Patent Application Ser. No. 63/139,073, filed Jan. 19, 2021, the disclosure of which is incorporated herein by reference.

TECHNICAL FIELD

This document relates generally to the helmet arts, and, more particularly, to a removable visor which may be fixed in position to a receiver of a helmet.

BACKGROUND

A helmet, such as for use in combat or training therefor, may include a receiver, such as along the front or forward portion thereof. This receiver may be adapted to mount an item of equipment or accessory, such as night-vision goggles, to the helmet. Forward receiver mounts for night vision goggles are used infrequently, as most troops are not issued such goggles, so the exposed mounts may be susceptible to impact and resulting damage. However, helmets so-adapted cannot typically have sun/debris visors because they interfere with the ability of the goggles to be placed over the eyes.

Accordingly, this disclosure proposes a sun/debris visor to interface with the receiver and provide shade for that majority of soldiers, rescuers etc. that use the helmet, while still allowing for the accommodation of an accessory, such as night-vision goggles or the like. Additionally, with the visor installed, the mount is protected from impact and potential damage, thus extending the service life of the helmet.

SUMMARY

It is an object of this disclosure to provide a visor adapted for attaching to a receiver on a helmet without losing the functionality ordinarily provided by the receiver of the helmet when not attached to the visor.

According to one aspect of the disclosure, an apparatus is provided for a helmet including a receiver adapted for connecting with an accessory. The apparatus comprises a visor adapted to releasably connect with the receiver, the visor including a repeater adapted to connect with the accessory when the visor is connected to the receiver.

In one embodiment, the visor includes a connector adapted to connect with the receiver. The connector may comprise a spring including a mounting tab. The repeater may be provided on a forward depending portion of the visor adapted to shield a wearer's eyes from sunlight when wearing the helmet. The repeater may include a slot for engaging the mounting tab.

The visor may further include one or more vents. The visor may additionally or alternatively include at least one elongated portion for matching a contour of the helmet. The elongated portion may include one or more openings adapted to connect with another accessory.

In one version, the receiver includes first connectors for connecting with the accessory. Likewise, the repeater includes second connectors for connecting with the accessory. The first and second connectors may be of the same type.

The visor may be further adapted to connect with a mounting assembly. The mounting assembly may include a picatinny rail.

According to a second aspect of the disclosure, an apparatus includes a helmet including a receiver adapted to connect with an accessory, as well as a visor adapted for releasably connecting with the receiver, the visor including a repeater adapted to connect with the accessory when the visor is connected to the receiver of the helmet.

In one embodiment, the visor includes a connector adapted to connect with the receiver. The connector may comprise a spring including a mounting tab. The repeater may be provided on a forward depending portion of the visor adapted to shield the wearer's eyes from sunlight when wearing the helmet.

The visor may include one or more vents. The visor may also include at least one elongated portion for matching a contour of the helmet, the elongated portion including one or more openings adapted to connect with another accessory.

In one version, the receiver includes first connectors for connecting with the accessory. Likewise, the repeater includes second connectors for connecting with the accessory. The first connectors and second connectors may be of the same type.

The visor may be adapted to connect with a mounting assembly. The mounting assembly may include a picatinny rail.

A further aspect of the disclosure pertains to an apparatus for connecting with a helmet. The apparatus comprises a visor adapted to connect to the helmet and a mounting assembly adapted to connect to the visor. In one embodiment, the mounting assembly includes a picatinny rail.

Yet another aspect of the disclosure pertains to a method of connecting an accessory to a helmet. The method comprises attaching a visor to a first receiver adapted to attach the accessory to the helmet, and attaching the accessory to a second receiver on the visor.

In one embodiment, the step of attaching the visor comprises biasing a spring on the visor to engage the first receiver. The method may also include the step of attaching a second accessory to the visor.

BRIEF DESCRIPTION OF THE DRAWING FIGURES

The accompanying drawing figures incorporated herein and forming a part of the specification, illustrate several aspects of the disclosed embodiments and, together with the description, serve to explain certain principles thereof. In the drawing figures.

Figure 1:
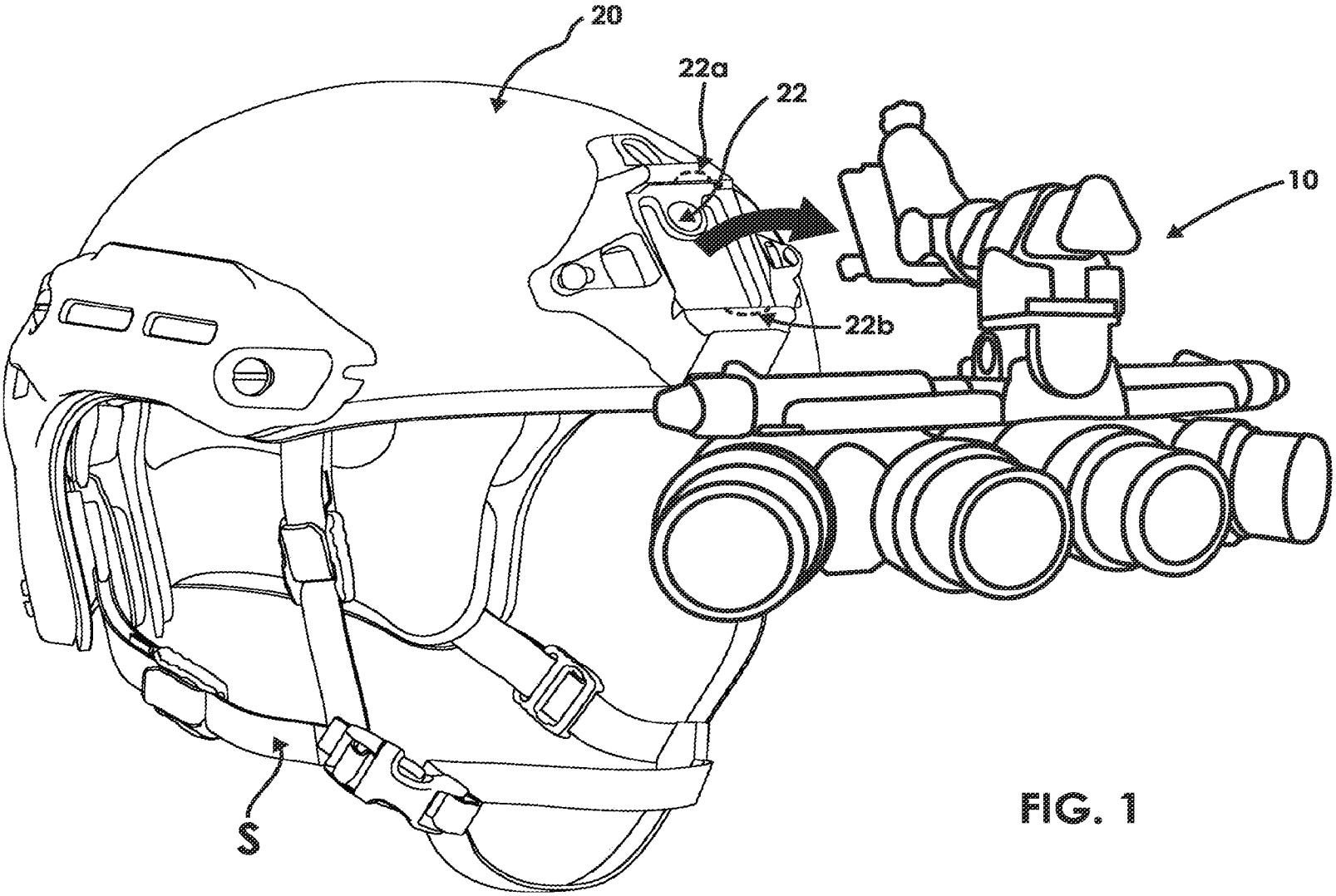
FIG. 1 is a perspective view showing the manner in which an accessory may be attached to a receiver of a helmet.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

Reference is now made to FIG. 1, which illustrates the manner in which a helmet 20 (which may include an optional strap S, as shown) is provided with a receiver 22 for mounting an accessory P, such as for example enhanced (night) vision goggles. As can be appreciated, the receiver 22 may connect with the accessory P using a first connection, such as a snap-fit connection, interference fit, or any other suitable connection, such that a user may readily and selectively attach and detach the accessory P from the receiver 22 of the helmet 20. However, once the attachment is made, the wearer is then unable to utilize the occupied receiver 22 for attaching other structures. The conventional form of helmet 20, as shown, also lacks a visor or other structure for shielding the wearer's eyes from sunlight.

Figure 2:
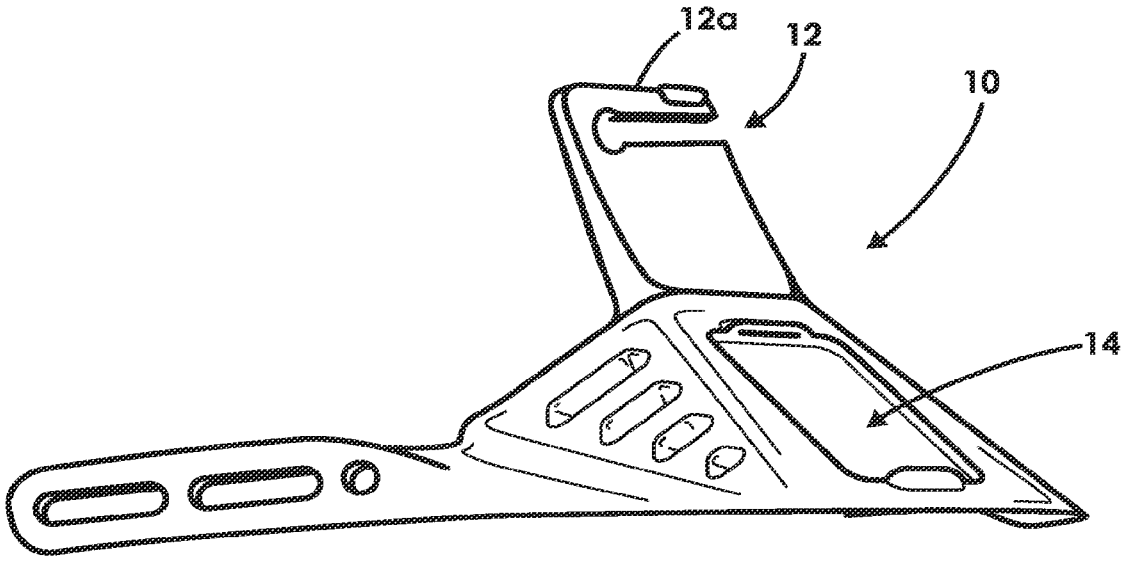
FIG. 2 is a perspective view of a visor according to one aspect of the disclosure.
Figure 2A:
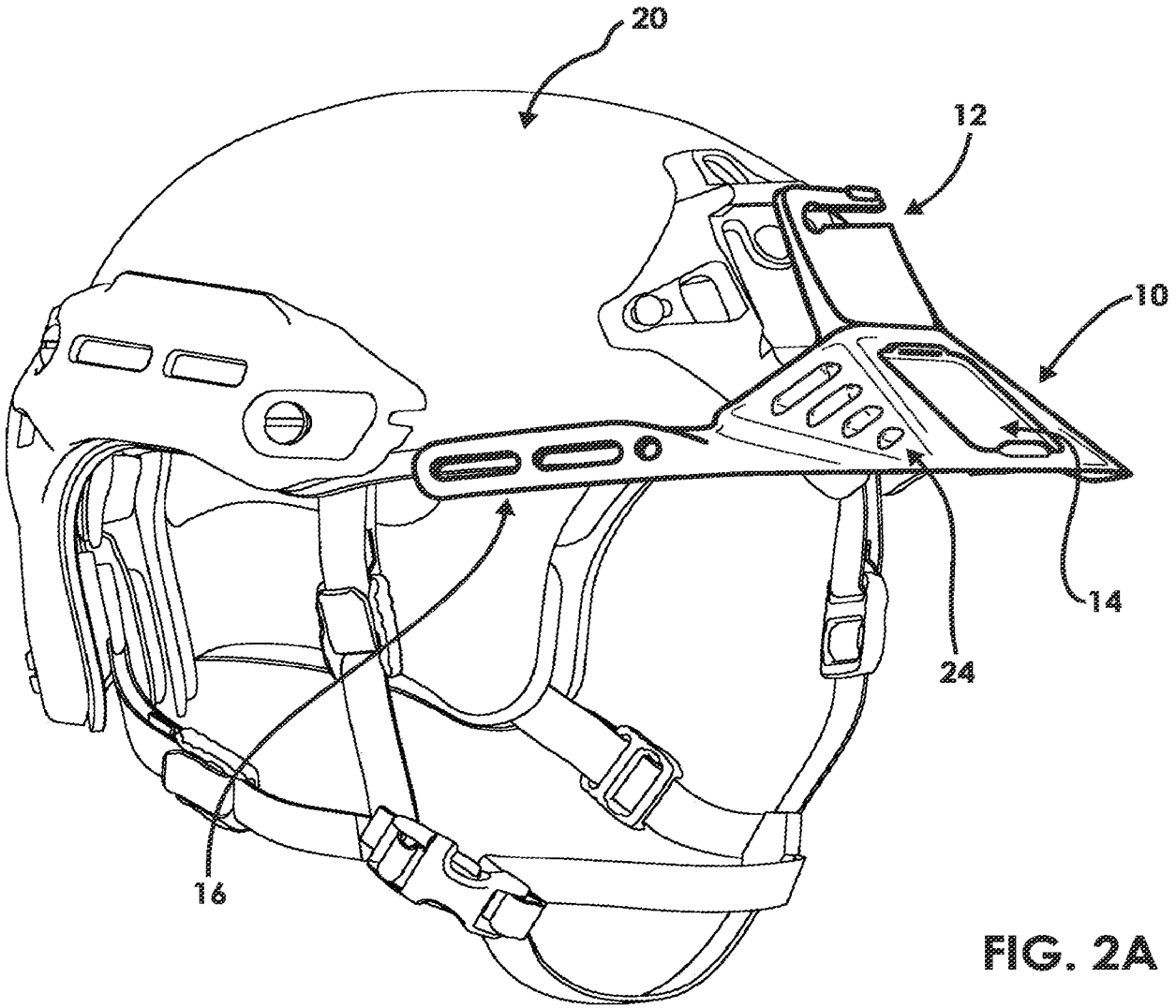
FIG. 2A is a perspective view, showing the visor of FIG. 2 attached to a receiver of a helmet.

Turning to FIGS. 2 and 2A, one aspect of the disclosure relates to a visor 10 that is both adapted to connect to the receiver 22 of the helmet 20, and also allow for the connection of an accessory, such as goggles (e.g., night vision) or any other accessory or item desired to be connected to the helmet. The visor 10 and, in particular, the receiver 22, thus essentially functions as a repeater by repeating the ability to connect with an accessory, even when the existing receiver 22 of the helmet 20 is occupied. The visor 10 also occupies the receiver 22 and protects it against damage when not in use for connecting another accessory.

In order to connect with the receiver 22, the visor 10 may include a connector 12 for connecting with the receiver 22. The connector 12 may include a first connection portion, which may take the form of a spring 12*a* (and, in particular, a cantilevered one) adjacent to an upper end portion of the visor 10. The spring 12*a* may comprise a cantilevered portion of the visor 10, and may include a first mounting tab 12*b* for engaging the receiver 22 (and in particular, a slot 22*a* formed therein).

Figure 3:
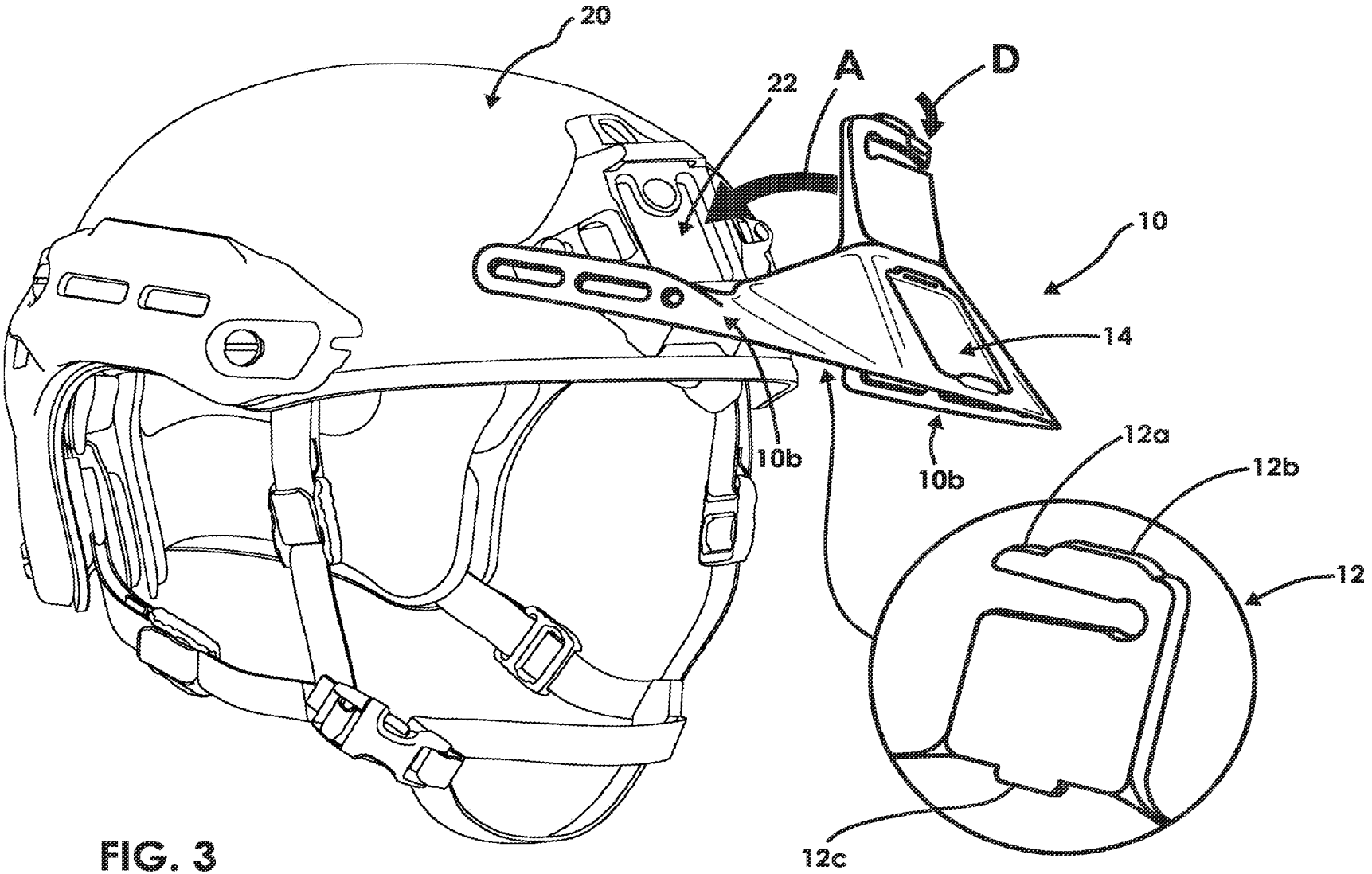
FIG. 3 is a perspective view illustrating the manner of connecting the visor to a helmet.

As perhaps best shown in the enlarged portion of FIG. 3, a lower portion of the connector 12 may include a mounting tab 12*c* for fitting into a lower slot 22*b* in the receiver 22. As indicated by action arrow A in FIG. 3, the mounting tab 12*c* may be partially inserted into the receiver 22, and then the spring 12*a* depressed (note arrow D) to allow for the first mounting tab 12*b* to enter the receiver 22 and become captured in the upper slot 22*a*. In this manner, the visor 10 is securely, but releasably attached to the receiver 22 of the helmet 20.

Figure 4:
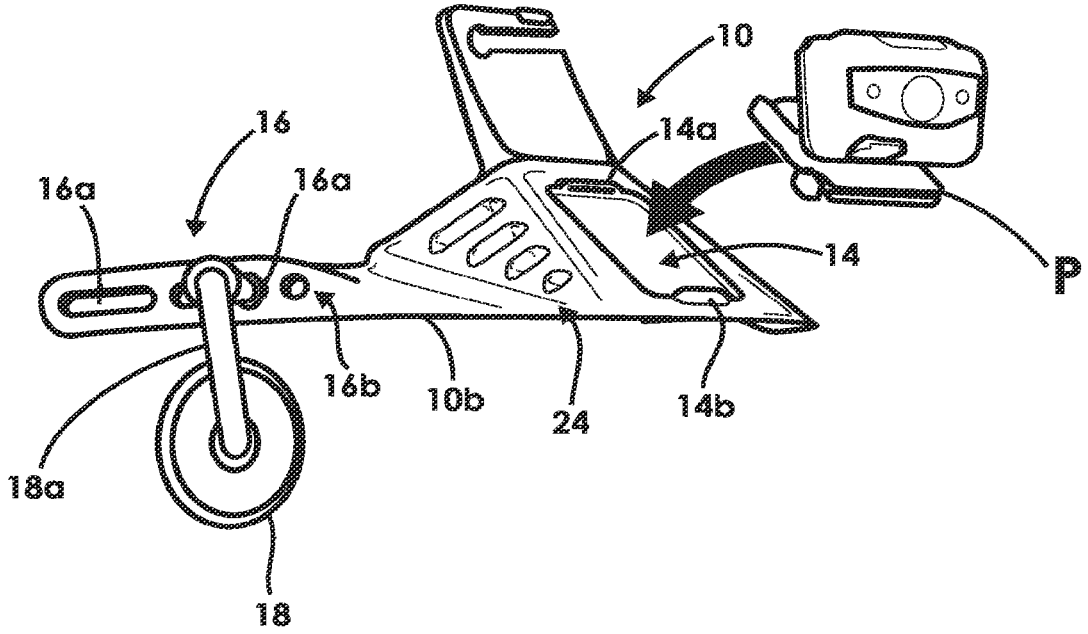
FIG. 4 is a perspective view of a visor according to one aspect of the disclosure.
Figure 4A:
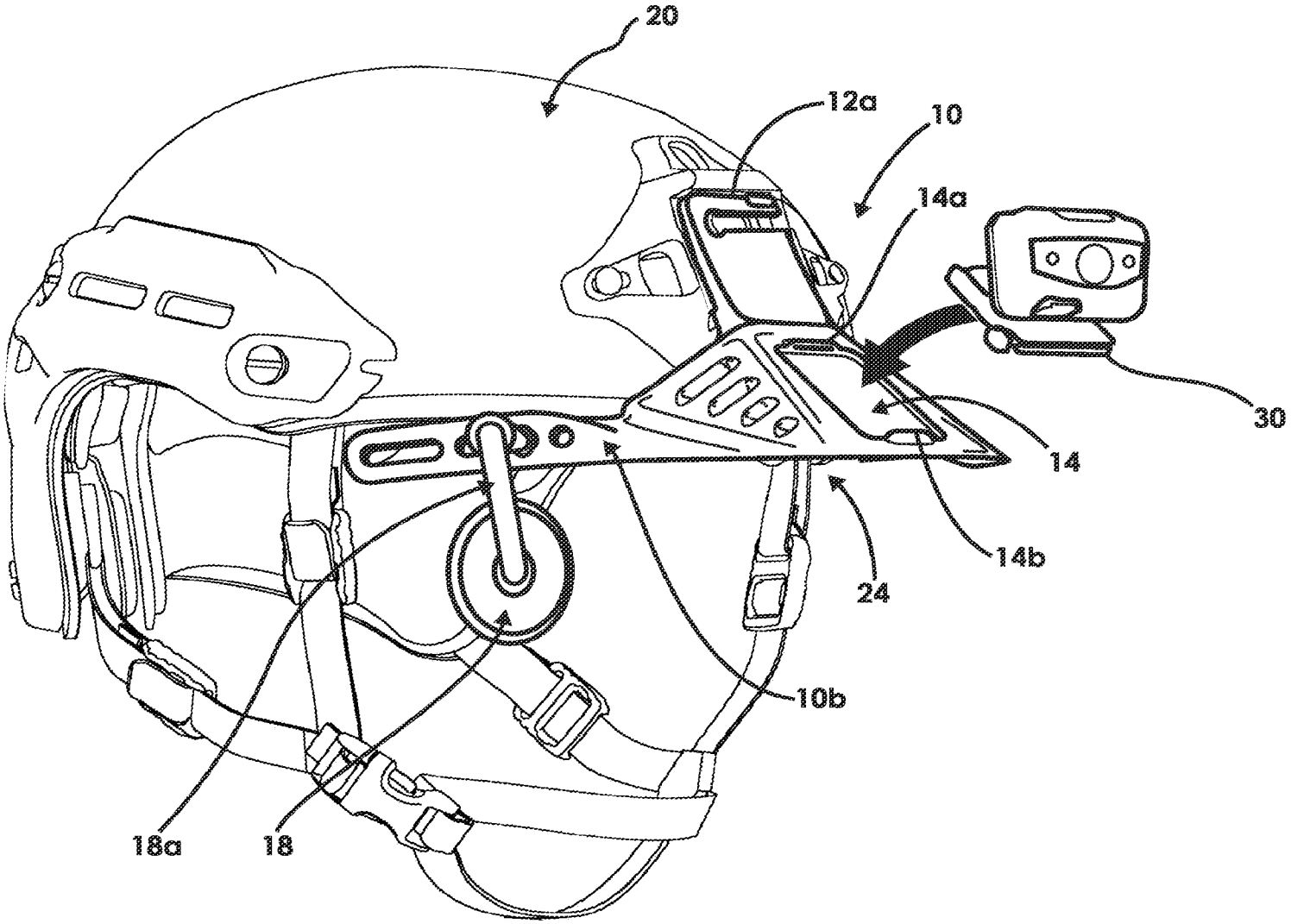
FIG. 4A is a perspective view, showing the visor of FIG. 3 attached to a receiver of a helmet.

To then repeat the lost functionality and still allow the helmet 20 to accommodate an accessory, the visor 10 is provided with a second receiver 14, including the same type of connector as the first receiver 22, and thus matching the functionality afforded by it. Specifically, this second receiver 14 may be provided on a lower forwardly projecting portion of the visor 10, and may include a connector, such as upper and lower slots 14*a*, 14*b* for engaging a similar or mating connector, such as tabs, on an accessory P, such as a mount for a camera, as shown in FIGS. 4 and 4A. The ability to mount additional items to the visor 10 significantly increases the functionality of the helmet 20, as the visor 10 may allow multiple accessories to be mounted to the helmet, even when the receiver 22 is occupied.

As further illustrated in FIGS. 4 and 4A, the visor 10 may comprise one or more side portions 10*b* matching the contour of the helmet 20 on either side (opposite side only partially shown but may be identical to side portion 10*b*). The side portion(s) 10*b* may be elongated, and further include one or more openings 16 for removably attaching additional accessories to the visor and thus the helmet 20. The openings 16 may be different shapes and sizes, such as slots 16*a* (multiple shown, but could be just one) or circular holes 16*b* (only one shown, but can be any number).

As one example of an equipment or accessory attachment situation, a mirror 18 (which may, for example, be parabolic) may be attached to at least one of the openings 16, which may be adapted to receive a conventional connector (e.g., ¼"-20 fasteners). In the example, the mirror 18 may be secured to at least one of the plurality of slots 16*a* in such a manner that a wearer is able to see rearwardly without having to turn around. This may be achieved by mounting the mirror 18 to an adjustable stem 18*a*, which allows the wearer to adjust the location of the mirror 18 until the desired field of vision can be seen by the wearer. The mirror 18 may further comprise a flip-up cover for preventing scratching and a screw on filter used to prevent glare and other undesired reflections from the mirror 18. In alternate embodiments, the accessories may further comprise indicator lights and other similar hardware.

FIG. 4 further demonstrates that the visor 10 along a side portion may comprise one or more vents 24. These vents 24 may serve to direct airflow away from a wearer. Thus, for example, in the event that a wearer is wearing goggles while the visor 10 is so equipped, the plurality of vents 24 may help to prevent fog from forming on the goggles.

Figure 5:
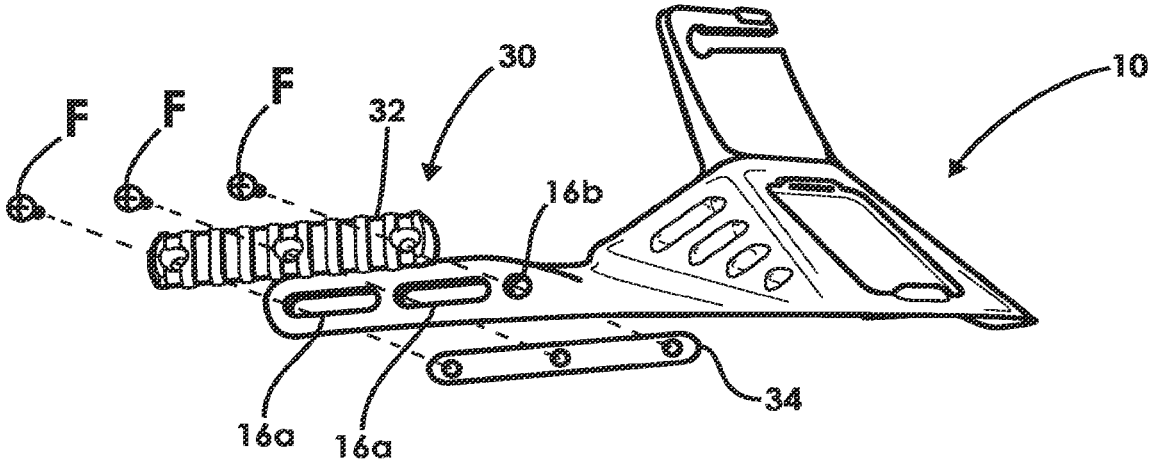
FIG. 5 is a perspective view of a visor according to another aspect of the disclosure.
Figure 5A:
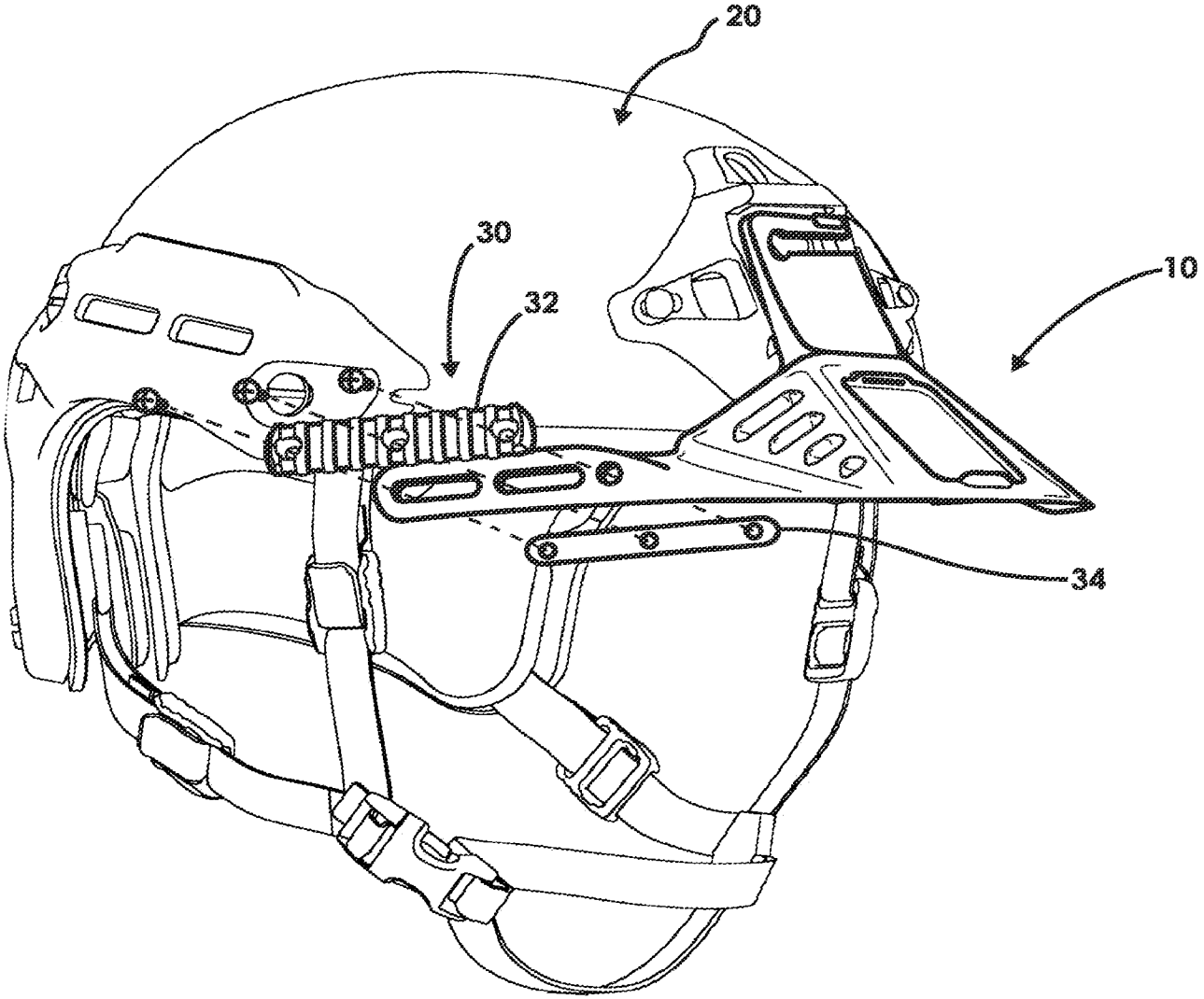
FIG. 5A is a perspective view, showing a visor including a mounting assembly, such as a picatinny rail attached to a receiver of a helmet.

With reference to FIGS. 5 and 5A, the visor 10 may further comprise a mounting assembly 30. For example, the mounting assembly 30 may include a picatinny rail 32, weaver rail, or the like, which may be mounted directly to the side portion 10*b* via the slots 16*a* and a corresponding aperture, such as a circular hole 16*b*, via fasteners F and a backplate 34. This further enhances the capabilities of forming connections between the helmet 20 and accessories via the visor 10.

Further disclosed is a method of securing a visor 10 to a helmet 20. The method may involve first depressing a spring 12*a* located on a connector 12 of the visor 10. Once the spring 12*a* is depressed, the connector 12 may be inserted into a receiver 22 of the helmet 20. Once the connector 12 is inserted into the receiver 22 of the helmet 20, the spring 18 is released, creating a connection, such as for example an interference fit, which secures the connector 12 within the receiver 22.

The method may further comprise mounting an additional accessory into a receiver 14 of the visor 10. In some embodiments, the accessory may be removably attached to the receiver 14, such that the accessory and receiver 14 form a snap-fit or any other type of engagement which allows the accessory to be removably attached to the receiver 14.

Summarizing, this disclosure pertains to the following items in any ordered combination:

1. An apparatus for a helmet including a receiver adapted for connecting with an accessory, comprising:
   a visor adapted to releasably connect with the receiver, the visor including a repeater adapted to connect with the accessory when the visor is connected to the receiver.
2. The apparatus of item 1, wherein the visor includes a connector adapted to connect with the receiver.
3. The apparatus of item 2, wherein the connector comprises a spring including a mounting tab.

4. The apparatus of any of items 1-3, wherein the repeater is provided on a forward depending portion of the visor adapted to shield a wearer's eyes from sunlight when wearing the helmet.

5. The apparatus of any of items 1-4, wherein the repeater includes an upper slot and a lower slot.

6. The apparatus of any of items 1-5, wherein the visor includes one or more vents.

7. The apparatus of any of items 1-6, wherein the visor includes at least one elongated portion for matching a contour of the helmet, the elongated portion including one or more openings adapted to connect with another accessory.

8. The apparatus of any of items 1-7, wherein:

the receiver includes first connectors for connecting with the accessory; and the repeater includes second connectors for connecting with the accessory;

wherein the first connectors and second connectors are of the same type.

9. The apparatus of any of items 1-8, adapted to connect with a mounting assembly.

10. The apparatus of item 9, wherein the mounting assembly includes a picatinny rail.

11. A helmet including the apparatus of any of items 1-10.

12. An apparatus, comprising:

a helmet including a receiver adapted to connect with an accessory; and a visor adapted for releasably connecting with the receiver, the visor including a repeater adapted to connect with the accessory when the visor is connected to the receiver of the helmet.

13. The apparatus of item 12, wherein the visor includes a connector adapted to connect with the receiver.

14. The apparatus of item 13, wherein the connector comprises a spring including a mounting tab.

15. The apparatus of any of items 12-14, wherein the repeater is provided on a forward depending portion of the visor adapted to shield the wearer's eyes from sunlight when wearing the helmet.

16. The apparatus of any of items 12-15, wherein the repeater includes an upper slot and a lower slot.

17. The apparatus of any of items 12-16, wherein the visor includes one or more vents.

18. The apparatus of any of items 12-17, wherein the visor includes at least one elongated portion for matching a contour of the helmet, the elongated portion including one or more openings adapted to connect with another accessory.

19. The apparatus of any of items 12-18, wherein:

the receiver includes first connectors for connecting with the accessory; and the repeater includes second connectors for connecting with the accessory;

wherein the first connectors and second connectors are of the same type.

20. The apparatus of any of items 12-19, adapted to connect with a mounting assembly.

21. The apparatus of item 20, wherein the mounting assembly includes a picatinny rail.

22. An apparatus for connecting with a helmet, comprising:

a visor adapted to connect to the helmet; and a mounting assembly adapted to connect to the visor.

23. The apparatus of item 22, wherein the mounting assembly includes a picatinny rail.

24. The apparatus of item 22 or item 23, wherein the visor includes a repeater for repeating the functionality of a receiver for receiving an accessory.

25. A helmet including the apparatus of any of items 22-24.

26. A method of connecting an accessory to a helmet, comprising:

attaching a visor to a first receiver adapted to attach the accessory to the helmet; and attaching the accessory to a second receiver on the visor.

27. The method of item 26, wherein the step of attaching the visor comprises biasing a spring on the visor to engage the first receiver.

28. The method of item 26 or item 27, further including the step of attaching a second accessory to the visor.

29. The method of item 26, wherein the step of attaching the accessory is completed after the step of attaching the visor to the helmet.

Having shown and described various embodiments, further adaptations of the apparatuses, methods and systems described herein may be accomplished by appropriate modifications by one of ordinary skill in the art without departing from the scope of the disclosure. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the disclosure should be considered in terms of claims that may be presented, and is understood not to be limited to the details of structure and operation shown and described in the specification and drawings.

As used herein, the following terms have the following meanings:

"A", "an", and "the" as used herein refers to both singular and plural referents unless the context clearly dictates otherwise. By way of example, "a compartment" refers to one or more than one compartment.

"About," "substantially," "generally" or "approximately," as used herein referring to a measurable value, such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows, e.g., "component includes" does not exclude or preclude the presence of additional, non-recited components, features, element, members, steps, known in the art or disclosed therein.

While certain embodiments have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the protection under the applicable law and that methods and structures within the scope of these claims and their equivalents be covered thereby.

What is claimed:

1. An apparatus, comprising:

a helmet including a helmet receiver adapted to connect with an accessory, the helmet receiver including a first helmet receiver slot and a second helmet receiver slot; and a visor adapted for releasably connecting with the helmet receiver, wherein the visor includes a connector adapted to connect with the helmet receiver, the connector including a cantilevered portion with a first tab for engaging the first helmet receiver slot and a second tab for engaging the second helmet receiver slot; and a visor receiver including a first visor receiver slot and a second visor receiver slot, the visor receiver adapted to connect with the accessory via the first visor receiver slot and the second visor receiver slot when the visor is connected to the helmet receiver;

wherein the first helmet receiver slot and the second helmet receiver slot are further adapted to engage the accessory when the visor is not connected with the helmet receiver.

2. The apparatus of claim 1, wherein the cantilevered portion comprises a spring.

3. The apparatus of claim 1, wherein the connector is provided on a forward depending portion of the visor adapted to shield the wearer's eyes from sunlight when wearing the helmet.

4. The apparatus of claim 1, wherein the visor includes one or more vents.

5. The apparatus of claim 1, wherein the visor includes at least one elongated portion for matching a contour of the helmet, the elongated portion including one or more openings adapted to connect with another accessory.

6. The apparatus of claim 1, wherein the visor is adapted to connect to the helmet with a mounting assembly.

7. The apparatus of claim 6, wherein the mounting assembly includes a picatinny rail.

* * * * *